US006000190A

United States Patent [19]

Richardson

[11] Patent Number: 6,000,190

[45] Date of Patent: Dec. 14, 1999

[54] STRUCTURAL MEMBERS

[75] Inventor: Christopher Richardson, Clitheroe, United Kingdom

[73] Assignee: Ultraframe (U.K.) Limited of Enterprise Works, Lancashire, United Kingdom

[21] Appl. No.: 09/004,974

[22] Filed: Jan. 12, 1998

[30] Foreign Application Priority Data

May 15, 1997 [GB] United Kingdom ..... 9709776

[51] Int. Cl.[6] ..... E04C 3/00

[52] U.S. Cl. ..... 52/734.2; 52/730.6; 52/731.7; 52/737.2; 52/506.07

[58] Field of Search ..... 52/DIG. 17, 734.2, 52/730.6, 731.7, 737.2, 506.07

[56] References Cited

U.S. PATENT DOCUMENTS

| | | | |
|---|---|---|---|
| 2,668,509 | 2/1954 | Fox-Williams | 52/82 |
| 3,155,461 | 11/1964 | Hunt | 52/730.6 X |
| 3,340,657 | 9/1967 | Thomas | 52/210 |
| 3,340,663 | 9/1967 | Collard | 52/775 |
| 4,222,210 | 9/1980 | Hanstein et al. | 52/734.2 X |
| 4,658,559 | 4/1987 | Doherty | 52/463 |
| 4,691,494 | 9/1987 | Gwynne | 52/729 |
| 4,875,311 | 10/1989 | Meyers | 52/DIG. 17 X |
| 4,918,882 | 4/1990 | Funk | 52/86 |
| 5,325,647 | 7/1994 | Forry et al. | 52/309.15 |

FOREIGN PATENT DOCUMENTS

| | | | |
|---|---|---|---|
| 2203768 | 4/1987 | United Kingdom | 52/DIG. 17 |

*Primary Examiner*—Beth Aubry
*Assistant Examiner*—Brian E. Glessner
*Attorney, Agent, or Firm*—Howell & Haferkamp, LC

[57] ABSTRACT

Structural members, such as glazing bars, are extruded from aluminium. Pockets are formed in the structural members to receive steel reinforcing elements.

11 Claims, 1 Drawing Sheet

STRUCTURAL MEMBERS

SUMMARY OF THE INVENTION

This invention concerns structural members, such as glazing bars for use in constructing conservatory roofs.

Glazing bars for making conservatory roofs are generally made of aluminium because of its lightness and ease of processing i.e. by extrusion. However, there are demands for stronger and cheaper glazing bars. Steel is about three times the strength of aluminium and less expensive but cannot be as easily processed.

An object of this invention is to provide improved structural members, such as glazing bars for use in constructing conservatory roofs.

According to this invention there is provided structural member, such as a glazing bar for use in constructing a conservatory roof, having a main body of aluminium with one or more additions of a reinforcing element, such as of steel.

It is envisaged that cables, rods, plates, strips or the like of steel, especially galvanised steel will be used as reinforcing elements to increase the strength of aluminium structural members. Such elements of steel may be added to the aluminium structural members in any suitable way. Simply, the steel elements may be riveted to the aluminium or fixed thereto by some other means.

More preferably the aluminium structural members are formed with pockets or the like to receive reinforcing elements. The reinforcing elements may be friction fits in said pockets or may be crimped into said pockets. Ideally, such crimping is carried out after extrusion of the aluminium but prior to tempering thereof. The term "pockets" is intended to include any type of slot, channel or the like having one or more sides that may be deformed to retain a reinforcing element.

The invention is believed to be particularly applicable to aluminium glazing bars. A typical glazing bar will be of inverted T-section having a cross bar and an upstanding stem. Reinforcing elements are preferably associated with the cross bar and/or the stem. With regard to the stem reinforcing elements are preferably associated with the stem head. Reinforcing elements may be provided singly or in pairs.

In siting reinforcing elements relative to an aluminium structural member consideration is desirably given to structural balancing of the member, so that the reinforcing elements are under strain when in situ.

This invention will now be further described, by way of example only, with reference to the accompanying drawings, in which:

DESCRIPTION OF THE PREFERRED EMBODIMENTS

Figure 1:
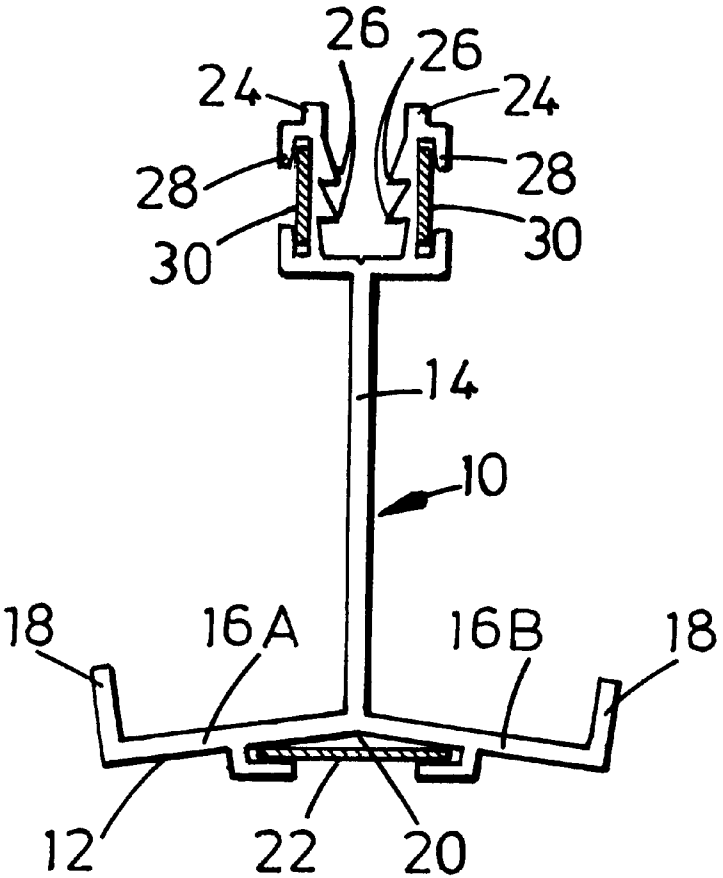
FIG. 1 shows a first glazing bar according to the invention.

Referring to FIG. 1 of the accompanying drawings a glazing bar 10 for use in constructing conservatory roofs is generally of inverted T-section and principally extruded from aluminium. The glazing bar 10 has a cross bar 12 and an upstanding stem 14. The cross bar 12 has two angled facets 16A and B with upturned flanges 18 at their remote ends. On the underside of the cross bar 12 is a channel 20 in which is retained a steel strip 22.

The stem 14 of the glazing bar 10 has a channel section head 24 having internally thereof teeth 26 along the length of the channel on both sides thereof. On the outside of the head on both sides thereof are slots 28 in which are situated steel strips 30.

The glazing bars 10 are intended to be used mainly between a roof ridge and eaves to support glazing panels therebetween. Plastics cappings may be used to hold edges of the glazing panels in position and to mask the glazing bars. A lower channel section capping is fitted onto the cross bar of the glazing bar and will usually carry gasket material either moulded integrally therewith or fitted thereto to seal against the underside of the glazing panels. A top capping is then fitted onto the head of the stem of the glazing bar. Such a capping will have depending internal formations that locate in the channel 24 being retained by the teeth 26. The lower edges of the top capping have gasket material thereon to seal against the top side of the glazing panels. For a better understanding of the above described arrangement attention is directed to our copending British Patent Application number 9705044.7.

The glazing bar 10 may be produced in the following manner. The main part of the glazing bar is extruded from aluminium and the steel strips are added before the aluminium is tempered in an oven, i.e. when it is still relatively soft and then the aluminium is crimped to grip the steel strips. The steel strips may, of course, be secured to the aluminium in any other suitable way including, for example, use of rivets or by making the steel strips friction fits in formations of the aluminium glazing bar.

Figure 2:
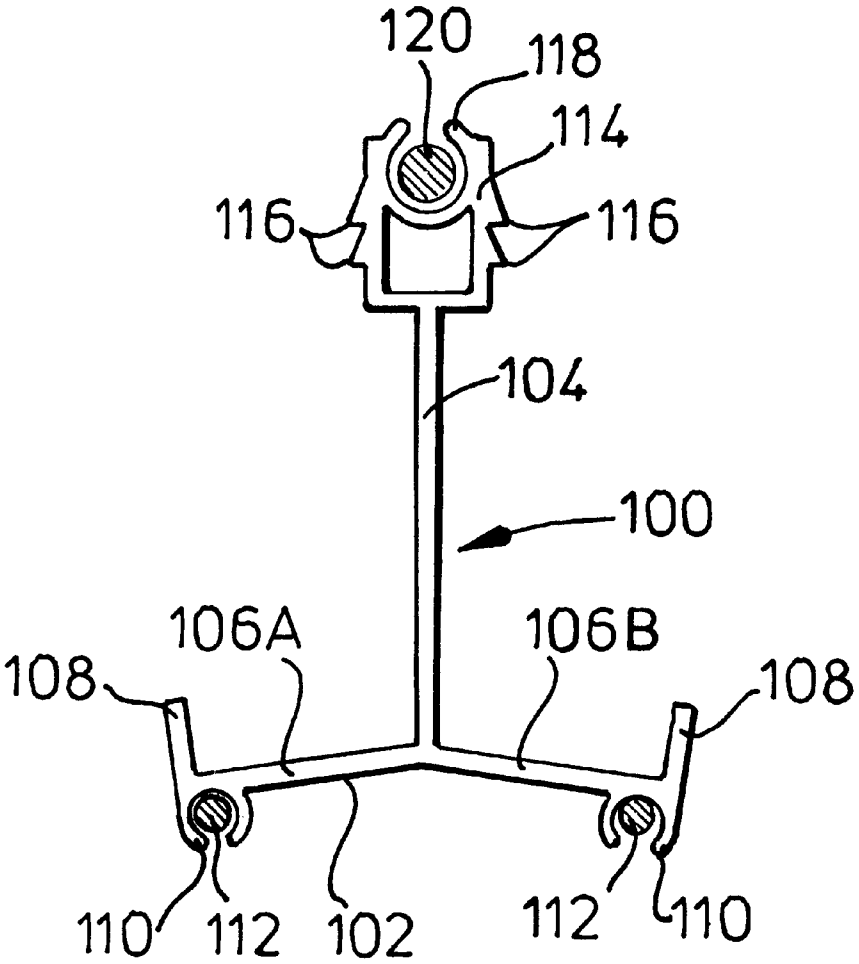
FIG. 2 shows a second glazing bar according to the invention.

Turning to FIG. 2 of the accompanying drawings, a glazing bar 100 for use in constructing conservatory roofs is generally of inverted T-section and principally extruded from aluminium. The glazing bar 100 has a cross bar 102 and an upstanding stem 104. The cross bar 102 has two angled facets 106A and 106B and an upturned flange 108 at each end. On the underside of each facet 106A, 106B below the flanges 108 are channel slots 110 in which are retained steel cables 112.

The stem 104 of the glazing bar 100 has a ducted head 114 thereon, which has on its outer sides teeth 116 extending lengthwise. In its top the head 114 has a longitudinal slot 118 in which is retained a steel cable 120.

The glazing bar 100 of FIG. 2 is used in much the same way as that of FIG. 1 except that the top capping used therewith will have internal depending formations that engage with the teeth 116 on the outside of the head 114.

The glazing bar 100 of FIG. 2 may be made in a similar way to that of FIG. 1 by crimping the steel rods into the aluminium of the glazing bar prior to tempering or indeed by any other suitable method.

Whilst the invention has been described with reference to inverted T-section glazing bars, it will be appreciated that the underlying principle of the invention, that is to reinforce aluminium structural elements with reinforcing elements, such as of steel, may be applied to other aluminium glazing bar formations or indeed to other aluminium structural members.

I claim:

1. A structural member for use in forming a glazed roof, the structural member being in the form of a glazing bar of inverted T-section having a cross bar and an upstanding stem with a head, the structural member having a main body of aluminum with at least one reinforcing element of steel received within the main body.

2. A structural member as claimed in claim 1, wherein the reinforcing element is of galvanised steel.

3. A structural member as claimed in claim 1, wherein the reinforcing element is in a form selected from cables, rods, plates and strips.

4. A structural member as claimed in claim 1, wherein the at least one reinforcing element is received in a pocket of the member.

5. A structural member as claimed in claim 4, wherein the at least one reinforcing element is a friction fit in said pocket.

6. A structural member as claimed in claim 4, wherein the at least one reinforcing element is crimped into said pocket.

7. A structural member as claimed in claim 6, wherein crimping of the reinforcing element into said pocket of the member is carried out after extrusional of the member but prior to tempering thereof.

8. A structural member as claimed in claim 1, wherein said at least one reinforcing element is associated with the stem head.

9. A structural member as claimed in claim 8 having a reinforcing element associated with the cross bar.

10. A structural member as claimed in claim 8 having a reinforcing element associated with each end of the cross bar.

11. A glazing bar for use in forming a glazed roof, the glazing bar being of inverted T-section forming a cross bar and an upstanding stem with a head on the stem, wherein the glazing bar is of aluminum having at least one reinforcing element of steel received within the aluminum and associated with at least one of the stem head and the cross bar.

* * * * *